US008965238B2

(12) United States Patent
Yamamoto

(10) Patent No.: US 8,965,238 B2
(45) Date of Patent: Feb. 24, 2015

(54) CHARGING DEVICE PROVIDED WITH A NON-CONTACT TYPE DISCHARGE ELECTRODE AND IMAGE FORMING APPARATUS INCLUDING THE CHARGING DEVICE

(75) Inventor: Masanobu Yamamoto, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 978 days.

(21) Appl. No.: 13/092,476

(22) Filed: Apr. 22, 2011

(65) Prior Publication Data

US 2011/0262176 A1 Oct. 27, 2011

(30) Foreign Application Priority Data

Apr. 22, 2010 (JP) ..... 2010-098600

(51) Int. Cl.
*G03G 21/20* (2006.01)
*G03G 15/02* (2006.01)

(52) U.S. Cl.
CPC ..... *G03G 15/0291* (2013.01); *G03G 2215/028* (2013.01)
USPC ..... 399/92; 399/170; 399/173; 399/100; 399/102

(58) Field of Classification Search
USPC ..... 399/170, 92, 100, 173, 102
See application file for complete search history.

(56) References Cited

U.S. PATENT DOCUMENTS

| | | | | | |
|---|---|---|---|---|---|
| 4,466,813 | A * | 8/1984 | Avritt et al. | 95/141 |
| 4,725,731 | A * | 2/1988 | Lang | 250/326 |
| 4,922,303 | A * | 5/1990 | Takeda et al. | 399/92 |
| 5,170,211 | A * | 12/1992 | Haupt et al. | 399/93 |
| 5,742,874 | A * | 4/1998 | Koshimura et al. | 399/100 |
| 7,149,458 | B2 * | 12/2006 | Zona et al. | 399/170 |
| 7,174,114 | B2 * | 2/2007 | Gila et al. | 399/100 |
| 7,251,439 | B2 * | 7/2007 | Robles Flores et al. | 399/172 |
| 7,415,218 | B2 * | 8/2008 | Hori et al. | 399/92 |
| 7,512,355 | B2 * | 3/2009 | Fujii et al. | 399/92 |
| 2001/0046394 | A1 * | 11/2001 | Yamanaka et al. | 399/170 |
| 2007/0025755 | A1 * | 2/2007 | Ishikawa et al. | 399/98 |
| 2007/0031163 | A1 * | 2/2007 | Katoh et al. | 399/91 |
| 2014/0186069 | A1 * | 7/2014 | Nogami et al. | 399/93 |

FOREIGN PATENT DOCUMENTS

| | | |
|---|---|---|
| JP | 9-197766 | 7/1997 |
| JP | 9-230668 | 9/1997 |
| JP | 10-307441 | 11/1998 |
| JP | 2006-098509 | 4/2006 |
| JP | 2006-119201 | 5/2006 |

* cited by examiner

*Primary Examiner* — G. M. Hyder
(74) *Attorney, Agent, or Firm* — Nixon & Vanderhye P.C.

(57) ABSTRACT

In a charging device, a holding member holding a discharge electrode is provided in a shield case. The holding member includes a first guide and a second guide defining a slit therebetween. In the slit, the rear face of the discharge electrode other than a first long side is fixed to the internal side face of the first guide. The holding member holds the discharge electrode so that the entire surface of the discharge electrode and the rear face of the first long side are positioned in an air path extending from the air inlet to a gap and the first long side faces a grid electrode.

18 Claims, 10 Drawing Sheets

CHARGING DEVICE PROVIDED WITH A NON-CONTACT TYPE DISCHARGE ELECTRODE AND IMAGE FORMING APPARATUS INCLUDING THE CHARGING DEVICE

CROSS REFERENCE

This Nonprovisional application claims priority under 35 U.S.C. §119(a) on Patent Application No. 2010-098600 filed in Japan on Apr. 22, 2010, the entire contents of which are hereby incorporated by reference.

BACKGROUND OF THE INVENTION

The present invention relates to a charging device provided with a non-contact type discharge electrode that electrical charges a photoreceptor for electrophotographic image formation, and relates to an image forming apparatus including the charging device.

Conventionally in some electrophotographic image forming apparatuses, a charging device including a shield case with an opening and a non-contact type discharge electrode fastened therein electrically charges a photoreceptor for image formation. The charging device generates corona discharge (hereinafter this may be simply referred to as discharge) from the tip end of the discharge electrode with a high voltage applied thereto with respect to the photoreceptor, thus electrically charging the photoreceptor.

In the charging device, ionic wind generated during discharging lets air flow into the shield case through the opening, and lets the air circulate in the shield case. At this time, if dust flows into the shield case from the outside, the dust will adhere to the discharge electrode. Although dust adhering to a part other than the tip end of the discharge electrode does not pose a problem, dust adhering to the tip end of the discharge electrode will result in a failure in uniform discharge, i.e., nonuniform discharge, so that the surface of the photoreceptor will not be electrically charged uniformly.

To cape with this, as disclosed in JP09-230668A (Patent Document 1), some conventional charging devices including a discharge electrode let air flow into a shield case through a slit formed in a base thereof, thereby letting ionic wind flow toward an opening of the shield case to prevent dust from adhering to the discharge electrode.

In the discharge electrode described in Patent Document 1, however, slits provided in the entire bottom face of the case cause air to flow through the entire shield case, thus slowing down the air flow rate, and therefore ionic wind cannot be sufficiently exhausted to the outside of the shield case through the opening. As a result, air passing over the surface of the photoreceptor tends to flow into the shield case. Further, since air in the shield case is exhausted toward the photoreceptor through the opening, dust such as silica particles and toner particles floating around the photoreceptor will be sucked into the shield case through the slits. In this way, the conventional charging devices fail to prevent dust from adhering to the tip end of an electrode reliably, and therefore cannot resolve the deterioration of an image quality due to nonuniform discharge sufficiently.

It is an object of the present invention to provide a charging device capable of preventing dust from adhering to a tip end of a discharge electrode reliably and resolving the deterioration of an image quality due to nonuniform discharge sufficiently, and to provide an image forming apparatus including the charging device.

SUMMARY OF THE INVENTION

A charging device of the present invention generates corona discharge with respect to a surface of a photoreceptor in an electrophotographic image forming apparatus, and includes a case, a discharge electrode and a holding member. The case has a first face and a second face, the first face facing the surface of the photoreceptor and including an opening, and the second face being opposed to the first face and including an air inlet. The discharge electrode has a first long side with a plurality of discharge ends disposed intermittently, from which corona discharge takes place. The holding member includes a slit defining an air path directed from the air inlet to an end portion of the first face of the case on a downstream side in a moving direction of the photoreceptor surface via a center portion in a cross section of the case, and holds the discharge electrode so that a tip end portion of the discharge electrode is positioned in the air path.

DETAILED DESCRIPTION OF THE INVENTION

The following describes an exemplary charging device according to an embodiment of the present invention and an image forming apparatus including the charging device, with reference to the drawings.

Figure 1:
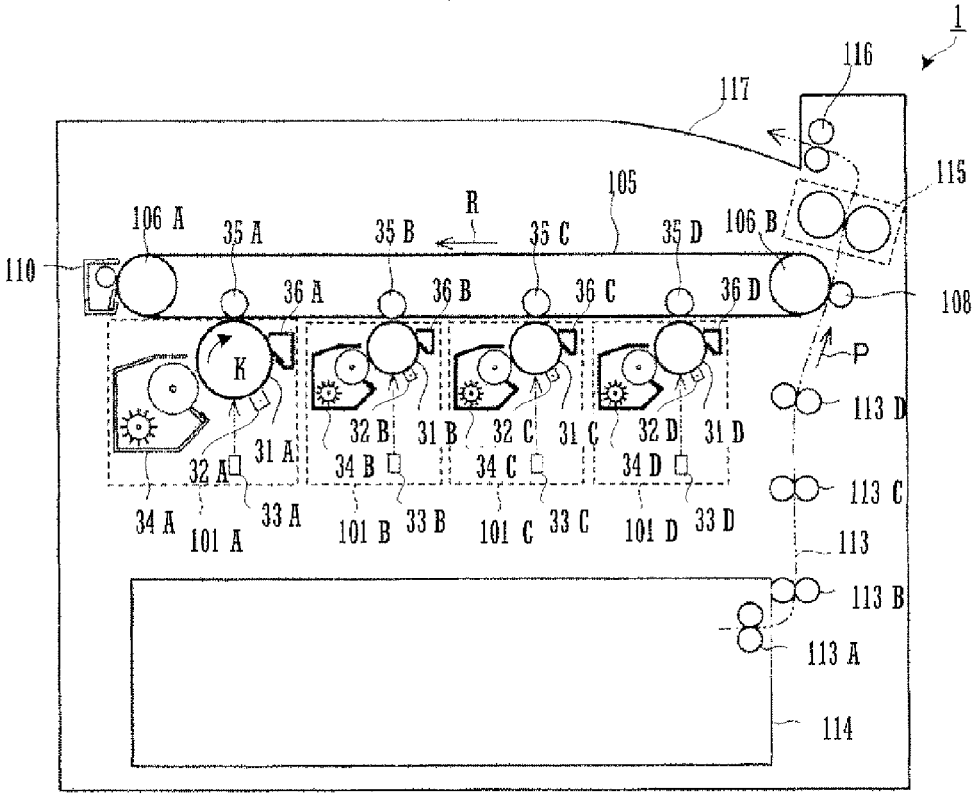
FIG. 1 is a schematic front view of an image forming apparatus provided with a charging device according to an embodiment of the present invention.

As illustrated in FIG. 1, an image forming apparatus 1 includes four image forming units 101A to 101D, an intermediate transfer belt 105, a secondary transfer roller 108, a belt cleaning unit 110, a sheet conveyance path 113, a tray 114, a fixing unit 115, an exit roller 116 and an exit tray 117.

The intermediate transfer belt 105 is an endless belt, hung between a supporting roller 106A and a supporting roller 106B, and rotates in the direction of arrow R. Inside the intermediate transfer belt 105 are disposed primary transfer rollers 35A to 350 between the supporting roller 106A and the supporting roller 106B. Outside the intermediate transfer belt 105 are provided the image forming units 101A to 101D, the secondary transfer roller 108 and the belt cleaning unit 110, which are disposed in this stated order along the rotation direction of the intermediate transfer belt.

The secondary transfer roller 108 is disposed as opposed to the supporting roller 106B with the intermediate transfer belt 105 sandwiched therebetween. The belt cleaning unit 110 is disposed as opposed to the supporting roller 106A with the intermediate transfer belt 105 sandwiched therebetween.

The four image forming units 101A to 101D form toner images of black, cyan, magenta and yellow, respectively. Since these image forming units 101A to 101D have the same configuration, the following describes the image forming unit 101A mainly.

The image forming unit 101A includes a charging device 32A, an exposure device 33A, a developing device 34A, the transfer device (the primary transfer roller) 35A and a cleaner device 36A, which are disposed around a photoreceptor drum 31A in this stated order. The photoreceptor drum 31A is disposed as opposed to the primary transfer roller 35A with the intermediate transfer belt 105 sandwiched therebetween.

Below the image forming units 101A to 101D is disposed the tray 114 holding sheet therein. Along the sheet conveyance path 113, a plurality of feed rollers 113A to 113D, the supporting roller 1061, the secondary transfer roller 108, the fixing unit 115 and the exit roller 116 are disposed in this stated order.

The image forming apparatus 1 operates as follows. The image forming units 101A to 101D form images in accordance with an instruction from a control unit. For instance, in the image forming unit 101A, the charging device 32A electrically charges the photoreceptor drum 31A, and the exposure device 33A forms an electrostatic latent image on the photoreceptor drum 31A. The developing device 34A supplies the photoreceptor drum 31A with toner, thus making the electrostatic latent image visible as a toner image. The primary transfer roller 35A transfers the toner image on the photoreceptor drum. 31A onto the intermediate transfer belt 105. The cleaner device 36A cleans the surface of the photoreceptor drum 31A after transferring of the toner image.

The single-colored toner images formed with the image forming units 101A to 101D are transferred onto the intermediate transfer belt 105 so as to overlap one another, thus forming a color image.

The sheets held in the tray 114 are taken out by the feed roller 113A and are conveyed by the feed rollers 113B to 113D in the direction of arrow P up to a secondary transfer position where the secondary transfer roller 108 faces the intermediate transfer belt 105.

The color image formed on the intermediate transfer belt 105 is transferred onto a sheet by the supporting roller 106B and the secondary transfer roller 108 at the secondary transfer position. The belt cleaning unit 110 cleans the surface of the intermediate transfer belt 105 after transferring of the color image.

The sheet with the color image transferred thereon is conveyed to the fixing unit 115. The fixing unit 115 fixes the color image to the sheet. The exit roller 116 ejects the sheet with the fixed color image to the exit tray 117.

The following describes the charging device in detail, exemplifying the charging device 32A of the image forming unit 101A. Since the charging device 32A of the image forming unit 101A has the same configuration as the charging devices 32B to 32D of the other image forming units 101E to 101D, letters such as A with the reference numerals used above for distinction among the image forming units will be omitted in the following embodiments unless otherwise specified.

Figure 2A:
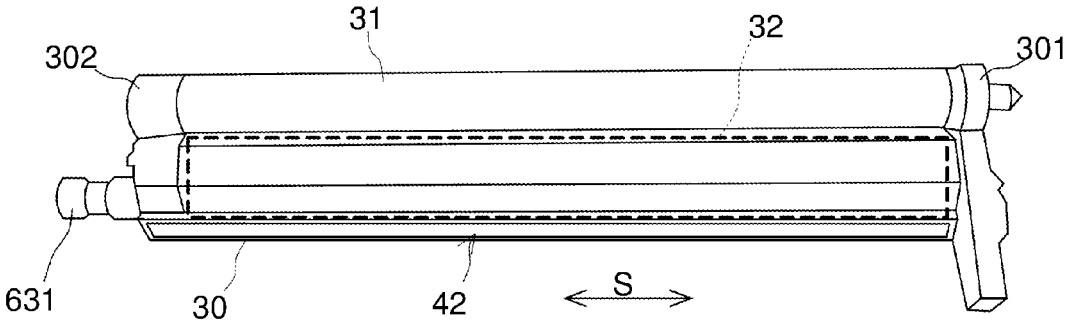
FIG. 2A is an outside view of a holder including a charging device.
Figure 2B:
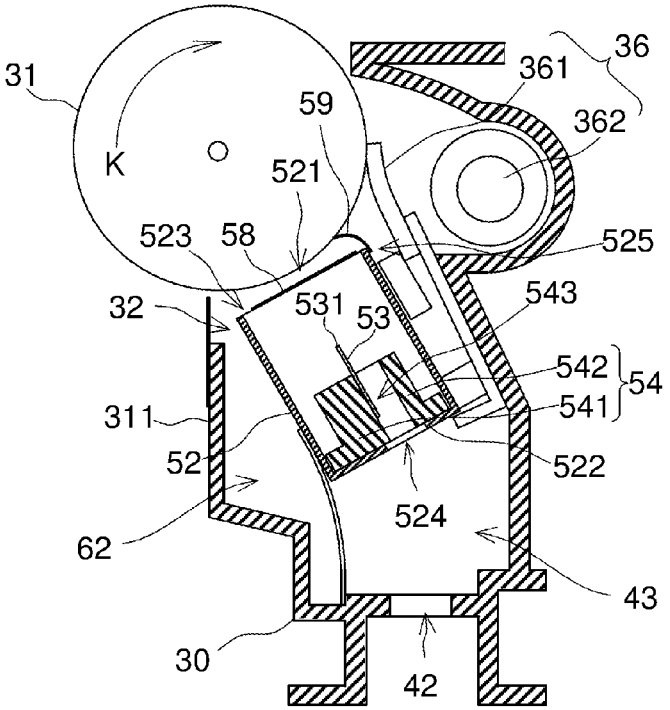
FIG. 2B is a cross-sectional view of the holder.

As illustrated in FIGS. 2A and 2B, the charging device 32 is placed in a holder 30 as well as the photoreceptor drum 31 and the cleaner device 36, for example.

The photoreceptor drum 31 is rotatably held by a supporter 301 and a supporter 302 provided at both ends of the holder 30. As illustrated by dashed lines in FIG. 2A, the charging device 32 is disposed at a position as opposed to the surface of the photoreceptor drum 31 across the overall width of the photoreceptor drum 31 in the shaft direction (the direction of arrow S).

The cleaner device 36 includes a blade 361 and a screw 362. The blade 361 removes residual toner and paper powder from the surface of the photoreceptor drum 31 by attaching the tip end thereof to the surface of the photoreceptor drum 31. The screw 362 conveys the residual toner and the paper powder removed from the surface of the photoreceptor drum 31 toward the exit (not illustrated) on the side of the supporter 301.

The holder 30 is provided with an air inlet 42 in a face on the opposite side of the photoreceptor drum 31 in the direction perpendicular to the rotational shaft of the photoreceptor drum 31. The supporter 302 is provided with a tubular air outlet 631 extending in the direction parallel to the rotational shaft of the photoreceptor drum 31. The air outlet 631 may include a fan disposed therein. The air outlet 631 communicates with a duct 62 formed between the charging device 32 and one side face 311 of the holder 30 so as to exhaust air from the duct 62.

As illustrated in FIG. 2B, the charging device 32 includes a shield case 52, a discharge electrode 53, a holding member 54 and a grid electrode 58.

The shield case 52 is a case with an opening at a first face 521, and is made of an electrically conducting material. The shield case 52 is held by the holder 30 in such a manner that the first face 521 is opposed to the surface of the photoreceptor drum 31 across the overall width. On the first face 521, the grid electrode 58 is disposed. A gap 523 is formed between one end portion of the first face 521 along one long side thereof (the end on the downstream side in the moving direction of the photoreceptor drum 31, as indicated by arrow K in FIG. 2B) and the grid electrode 58. A second face 522 of the shield case 52 opposed to the first face 521 is formed with an air inlet 524.

The holding member 54 includes a first guide 541 and a second guide 542, and is fixed to the second face 522. The first guide 541 and the second guide 542 define a slit 543 between their internal side faces, the slit 543 extending from the air inlet 524 to an intermediate part between the first face 521 and the second face 522. The holding member 54 holds the discharge electrode 53 in such a manner that the rear face of the discharge electrode 53 other than a first long side 531 is fixed to the internal side face of the first guide 541 positioned on the side of the gap 523 and the first long side 531 faces the grid electrode 58.

Thus, the holding member 54 holds the discharge electrode 53 in such a manner that the entire surface of the discharge electrode 53 and the rear face of the first long side 531 are positioned in an air path extending from the air inlet 524 to the gap 523 and the first long side 531 faces the grid electrode 58.

Note here that the first guide 541 and the second guide 542 may be configured integrally, or may be configured with separate members. The grid electrode 58 is not essential.

At an end portion 525 of the first face 521 on the side of the other long side (the end on the upstream side in the moving direction of the photoreceptor drum 31) on the opposite side of the gap 523, a seal member 59 is disposed across the overall width of the photoreceptor drum 31 in the shaft direction so that the tip end of the seal member 59 comes into contact with the surface of the photoreceptor drum 31.

Figure 3:
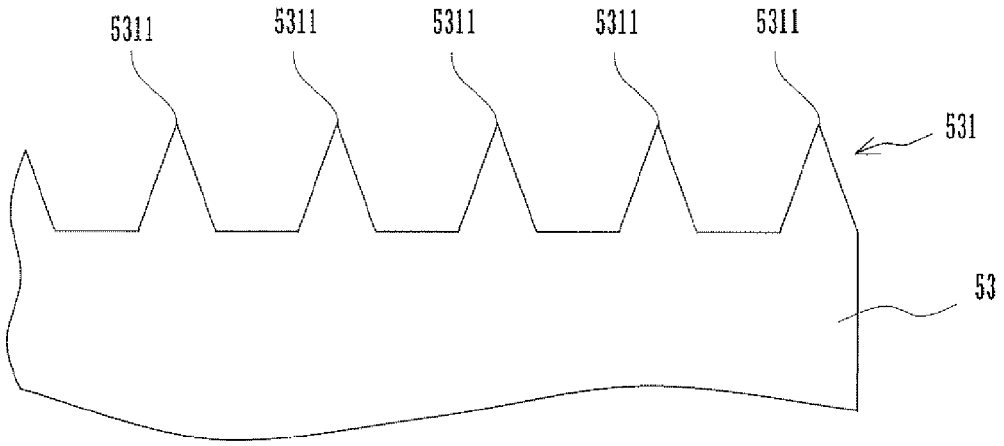
FIG. 3 provides an overview of a discharge electrode.

As illustrated in FIG. 3, the discharge electrode 53 typically is a sawtooth-shape electrode, having a flat shape with a plurality of discharge tips 5311 disposed intermittently and at regular intervals along the longitudinal direction of the first long side 531. When a charge voltage is applied to the discharge electrode 53, corona discharge takes place from each of the plurality of discharge tips 5311 toward the grid electrode 58. This corona discharge generates corona wind directed from each of the plurality of discharge tips 5311 toward the grid electrode 58, and as illustrated in FIG. 4, external air will flow into the shield case 52 from the air inlet 524 toward the first face 521.

More specifically, when a negative high voltage around −5 kV is applied to the discharge electrode 53 from a high-voltage power supply (not illustrated), electric field will concentrate on the plurality of discharge tips 5311, so that discharging starts from the plurality of discharge tips 5311. In a discharge area, gas such as oxygen ionizes, so that ions negatively charged (charged particles) and ozone as a result of dissociation and combination of oxygen are generated. Ions generated in the discharge area move along the electric field. At this time, when negative voltage lower than the voltage applied to the discharge electrode 53, e.g., of around −650 V, is applied to the grid electrode 58, the ions move from the discharge electrode 53 toward the grid electrode 58. A part of the ions flow through the grid electrode 58, and the remaining ions pass through the grid electrode 58 to reach the photoreceptor drum 31 and electrically charge the surface of the photoreceptor drum 31. As the ions move from the vicinity of the discharge electrode 53 toward the grid electrode 58, corona wind occurs.

Figure 4:
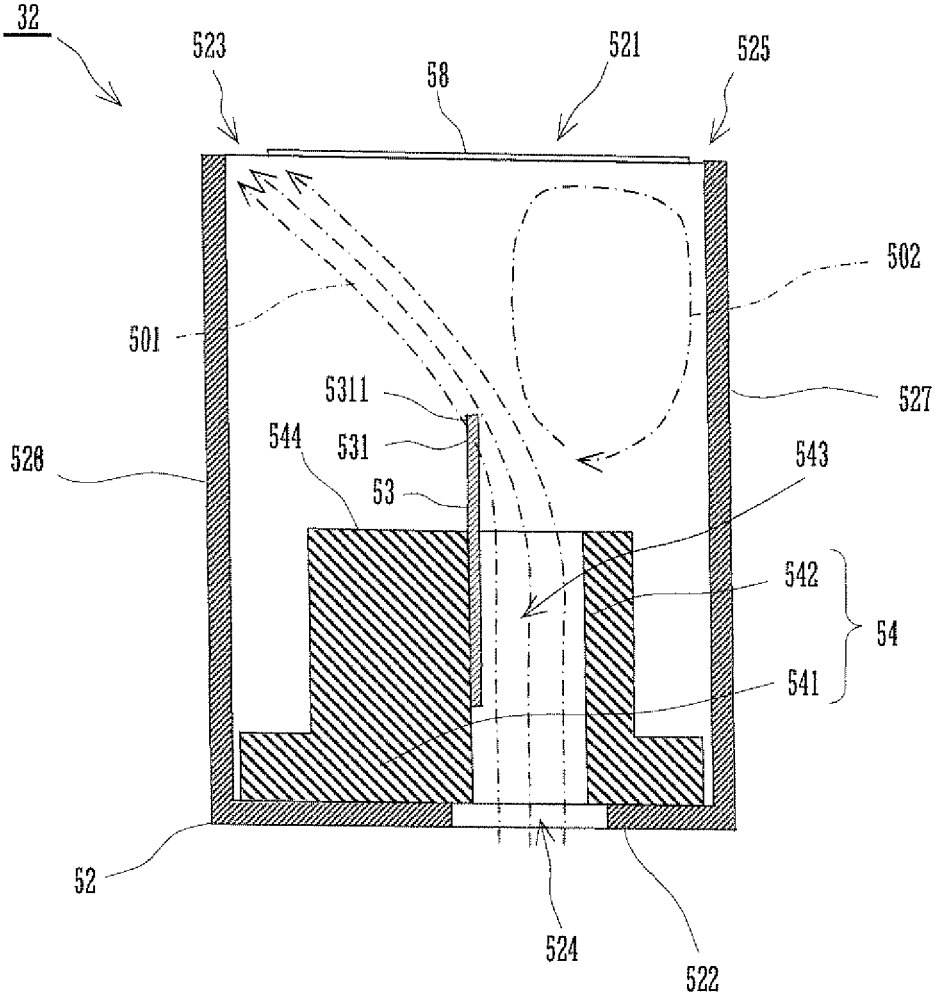
FIG. 4 is a cross-sectional view of a charging device.

As illustrated in FIG. 4, a gap 523 is formed in the first face 521 of the shield case 52 at an end portion along one long side, and the seal member 59 is disposed externally at the end portion 525 along the other long side, and therefore external air flowing into the shield case 52 is mainly exhausted through the gap 523 to the outside. Thus, an air path 501 of a relatively high flow velocity is formed in a space from the air inlet 524 to the gap 523, whereas an air flow 502 of a relatively low flow velocity is formed around the end portion 525 along the other long side.

In the shield case 52, a part of side faces 526 and 527 located above a top face 544 of the holding member 54 functions as a counter electrode of the discharge electrode 53.

Dust passing through the blade 361 of the cleaner device 36 and flowing into the shield case 52 is not carried by the speedy air flow in the air path 501, but stays in the slow air flow 502. Since the first long side 531 of the discharge electrode 53 is located in the air path 501, the plurality of discharge tips 5311 formed along the first long side 531 are surrounded by the relatively speedy air flow. As a result, dust will not adhere to the plurality of discharge tips 5311.

Note that preferably the slit 543 does not include any object disposed therein to substantially restrict the external air flowing through the air inlet 524. Thereby, sufficient amount of external air flowing through the air inlet 524 can be secured, and the velocity in the air path 501 does not reduce. The slit 543 has a predetermined length in the flowing direction of the external air flowing therein. Thereby, the flow of air can be stably formed in the air path 501 from the air inlet 524 to the gap 523 via the first long side 531 of the discharge electrode 53. A sufficient length of the slit 543 in the air path 501 set depending on the position of the first long side 531 of the discharge electrode 53 can suppress the spreading of the air flow above the slit 543 and can increase the flow velocity in the air path 501, thereby effectively preventing dust from adhering to the discharge tips 5311.

Even when the application of the charge voltage to the discharge electrode 53 is stopped, dust remaining in the shield case 52 mainly adheres to the inner face of the shield case 52 on the side of the end portion 525 along the long side, whereby adherence of dust to the plurality of discharge tips 5311 can be suppressed.

Thereby, adherence of dust such as silica particles and toner particles to the discharge tips 5311 of the discharge electrode 53 can be prevented, so that deterioration of an image quality due to nonuniform discharge on the surface of the photoreceptor drum 31 can be prevented.

Further, as illustrated in FIG. 2B, since the holder 30 is provided with the air inlet 42 at the face on the opposite side of the face opposed to the photoreceptor drum 31, the air inlet 42 is kept away from the photoreceptor drum 31, so that air with small amount of dust is allowed to flow into the shield case 52.

The air inlet 42 may be configured to face the outside of the image forming unit 101A. Since fewer amount of dust floats outside the image forming unit 101, air with smaller amount of dust is allowed to flow into the shield case 52.

As another configuration, a duct may be jointed with the air inlet 42 so that air free from dust is taken from the outside of the image forming apparatus 1. For instance, a duct open to the front side (front side in FIG. 1) of the image forming apparatus 1 may be jointed to the air inlet 42. The air inlet 42 further may be attached with a filter.

In the present invention, in order to prevent air exhausted from the charging device 32 from remaining in the image forming unit 101, the air outlet 631 is provided to exhaust the air to the outside of the image forming unit 101. Air exhausted from the charging device 32 is discharged through the air outlet 631. The air outlet 631 is provided at a position kept away from the air inlet 42. For instance, when the air inlet 42 is provided at the front face of the image forming apparatus 1, the air outlet 631 is jointed with the rear face of the image forming apparatus 1 on the opposite side. Thereby, air containing dust discharged from the air outlet 631 will not be sucked through the air inlet 42.

The air outlet 631 may be attached with a filter so as not to discharge dust through an exhaust duct 621.

The air inlet 42 or the air outlet 631 may be attached with a fan so that the outside of the gap 523 is placed under a negative pressure than the inside, whereby the velocity in the air path 501 can be further increased. In this case, the fan may be configured to operate when the application of a charge voltage the discharge electrode 53 is stopped, whereby adherence of dust to the discharge tips 5311 further can be suppressed.

Referring next to FIGS. 5 to 10, the following describes modification examples of the charging device according to embodiments of the present invention. As illustrated in FIG. 5A, in a charging device 132 according to a first modification example, a holding member 154 is provided in a shield case 52, the holding member 154 including a second guide 1542 having a length larger than that of a first guide 1541 in the direction from the second face 522 toward the first face 521. With this configuration, an air path 1501 can be securely directed to the gap 523 after passing through a slit 1543, and the amount and the velocity of air flowing in the air path 1501 can be increased.

Note here that the first guide 1541 and the second guide 1542 may be configured integrally, or may be configured with separate members.

Figure 5A:
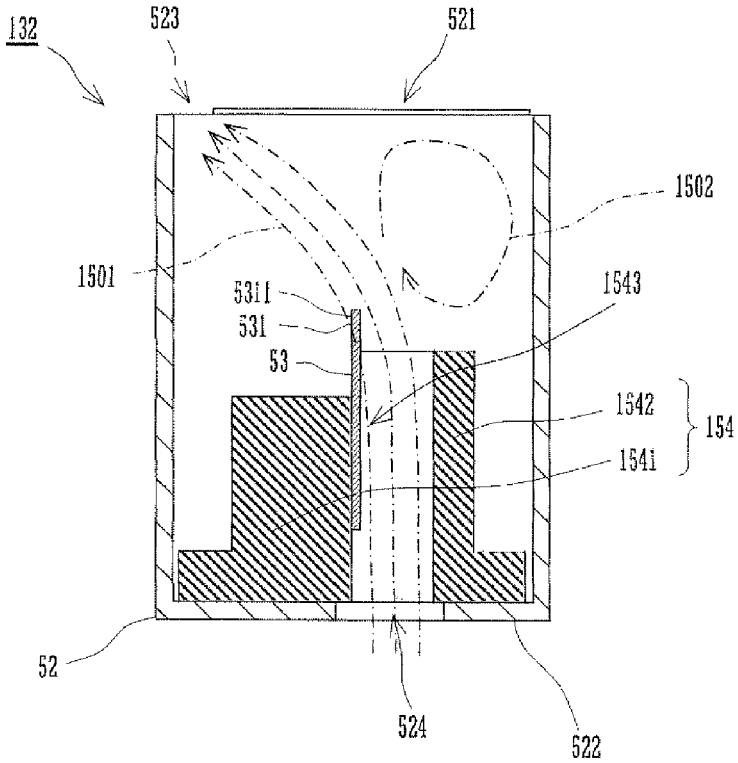
FIGS. 5A and 5B are cross-sectional views of first and second modification examples of a charging device according to embodiments of the present invention, respectively.
Figure 5B:
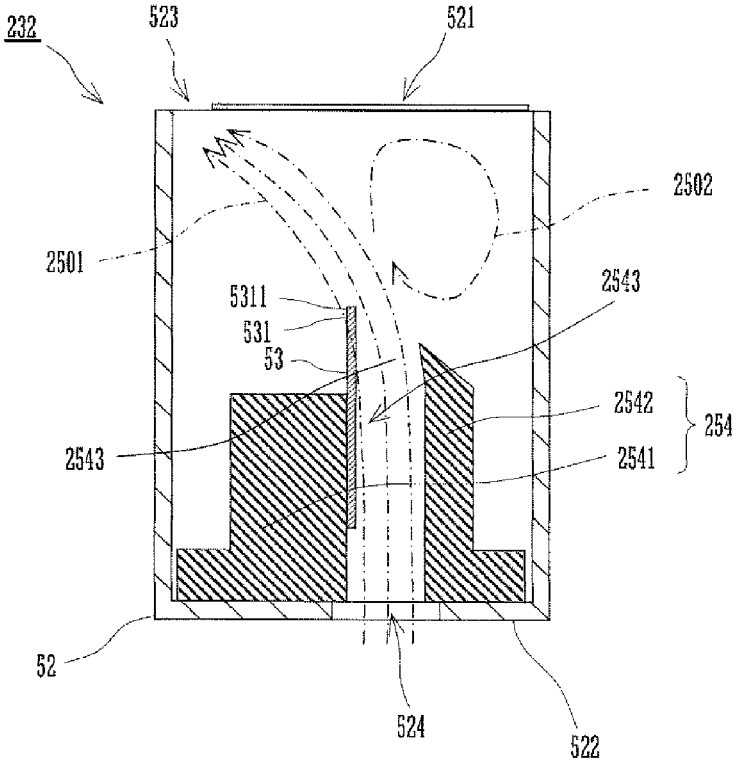

As illustrated in FIG. 5B, in a charging device 232 according to a second modification example, a holding member 254 is provided in a shield case 52, the holding member 254 having an inclined face 254A configured to incline the internal side face of a second guide 2542 at an end portion on the side of the first face 521 toward the internal side face of a first guide 2541. With this configuration, an air path 2501 can be securely directed to the gap 523 after passing through a slit 2543, and the amount of air flowing in the air path 2501 can be increased. A throttling effect by the slit 2543 on the side of the first face 521 can further increase the flow velocity in the air path 2501. This throttling effect by the inclined face 254A can be achieved irrespective of a relationship between the length of the first guide 2541 and the length of the second guide 2542 in the direction from the second face 522 toward the first face 521.

Note here that the first guide 2541 and the second guide 2542 may be configured integrally, or may be configured with separate members.

Figure 6:
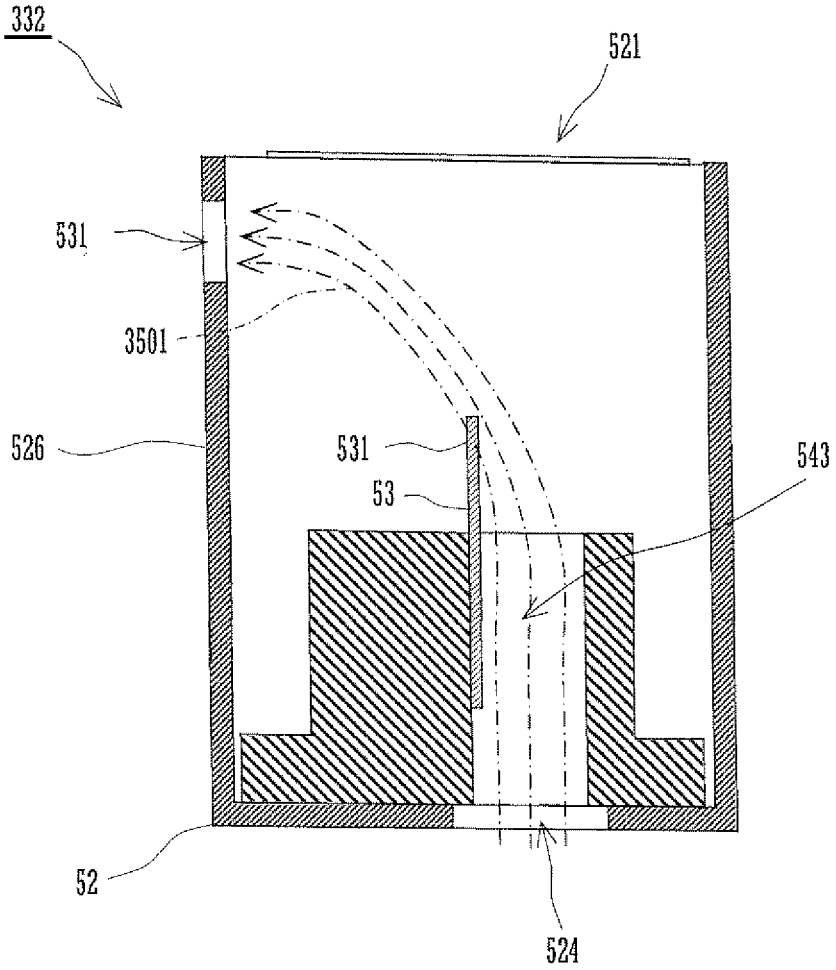
FIG. 6 is a cross-sectional view of a third modification example of a charging device according to one embodiment of the present invention.

As illustrated in FIG. 6, in a charging device 332 according to a third modification example, an air outlet 531 is formed at an upper portion of a side face 526 of a shield case 52. The air outlet 531 is formed in the shield case 52 on the side of the downstream, side end portion of the first face 521 in the moving direction of the surface of the photoreceptor drum 31. Thereby, an air path 3501 is formed in the shield case 52 leading from an air inlet 524 to downstream side end portion of the top face 521 in the moving direction of the surface of the photoreceptor drum 31 via a slit 543 and a center portion of the shield case 52, and in this air path 3501, discharge tips 5311 of a discharge electrode 53 are positioned.

Figure 7:
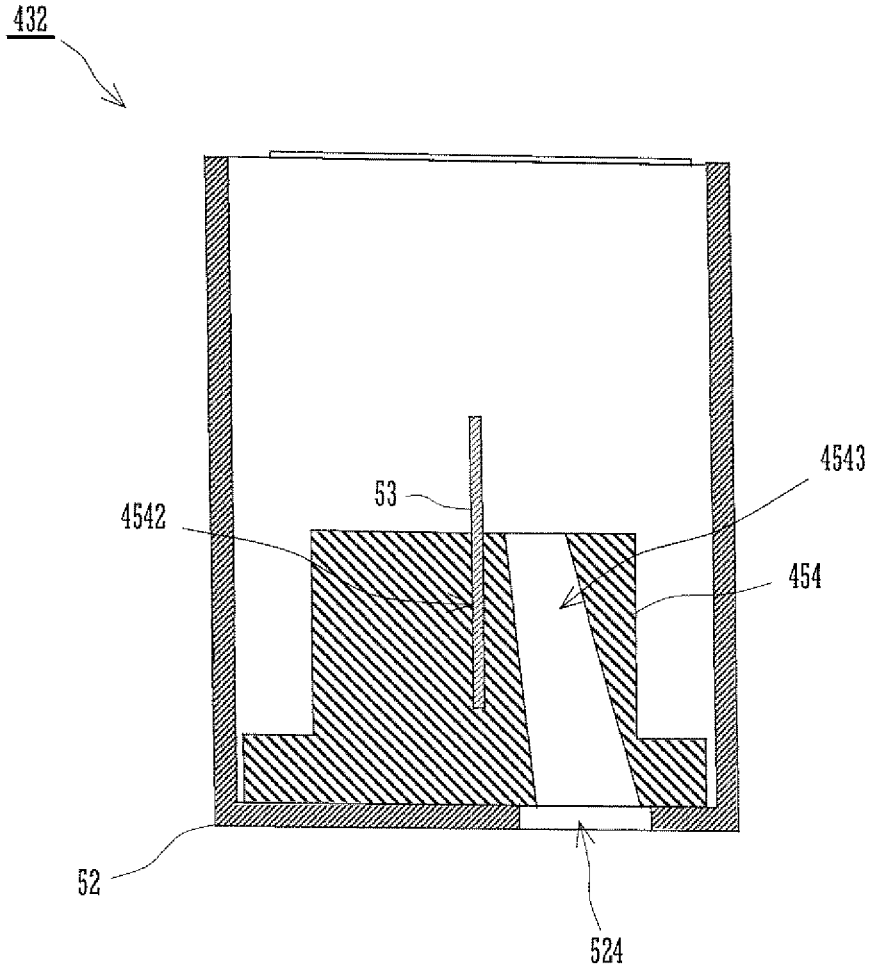
FIG. 7 is a cross-sectional view of a fourth modification example of a charging device according to one embodiment of the present invention.

As illustrated in FIG. 7, in a charging device 432 according to a fourth modification example, a single holding member 454 including a holder 4542 and a slit 4543 formed therein is provided in a shield case 52. The holding member 454 holds an electrode 53 in the holder 4542.

Figure 8:
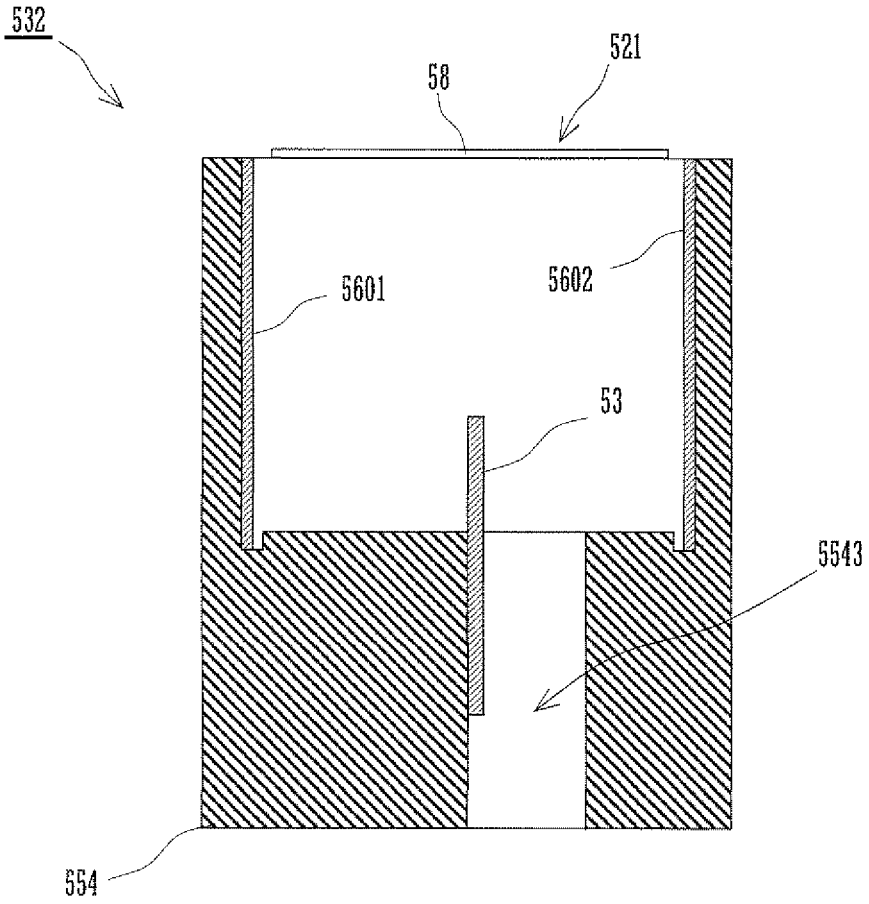
FIG. 8 is a cross-sectional view of a fifth modification example of a charging device according to one embodiment of the present invention.

As illustrated in FIG. 8, in a charging device 532 according to a fifth modification example, a box-shaped holding member 554 is provided. The holding member 554 is made of an electrical insulating material, and an electrode 53 is attached to one inner wall of a slit 5543. On inner walls of the holding member 554 are attached counter electrodes 5601 and 5602 of the electrode 53.

Figure 9:
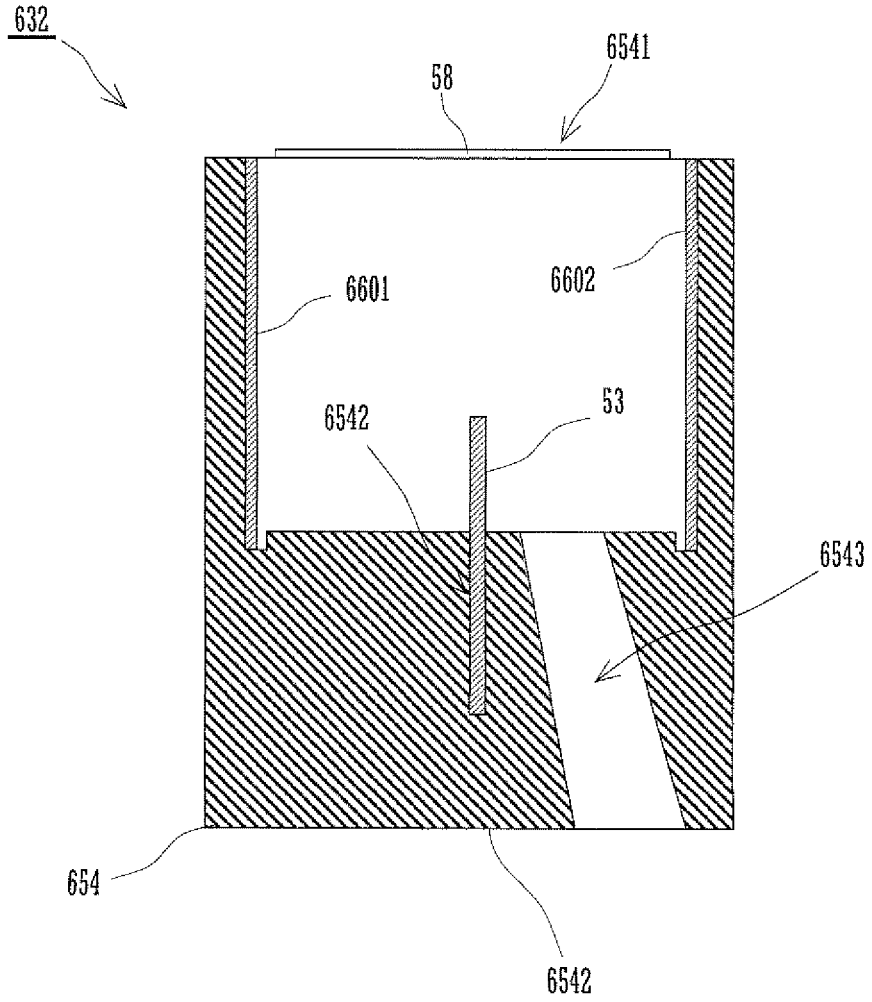
FIG. 9 is a cross-sectional view of a sixth modification example of a charging device according to one embodiment of the present invention.

As illustrated in FIG. 9, in a charging device 632 according to a sixth modification example, a box-shaped holding member 654 is provided. The holding member 654 is made of an electrical insulating material, and includes a holder 6542 and a slit 6543 formed therein. The holder 6542 holds an electrode 53. The slit 6543 communicates with a bottom face 6542 of the holding member 654 and the inside of the holding member 654. On inner walls of the holding member 654 are attached counter electrodes 6601 and 6602 of the electrode 53.

Figure 10:
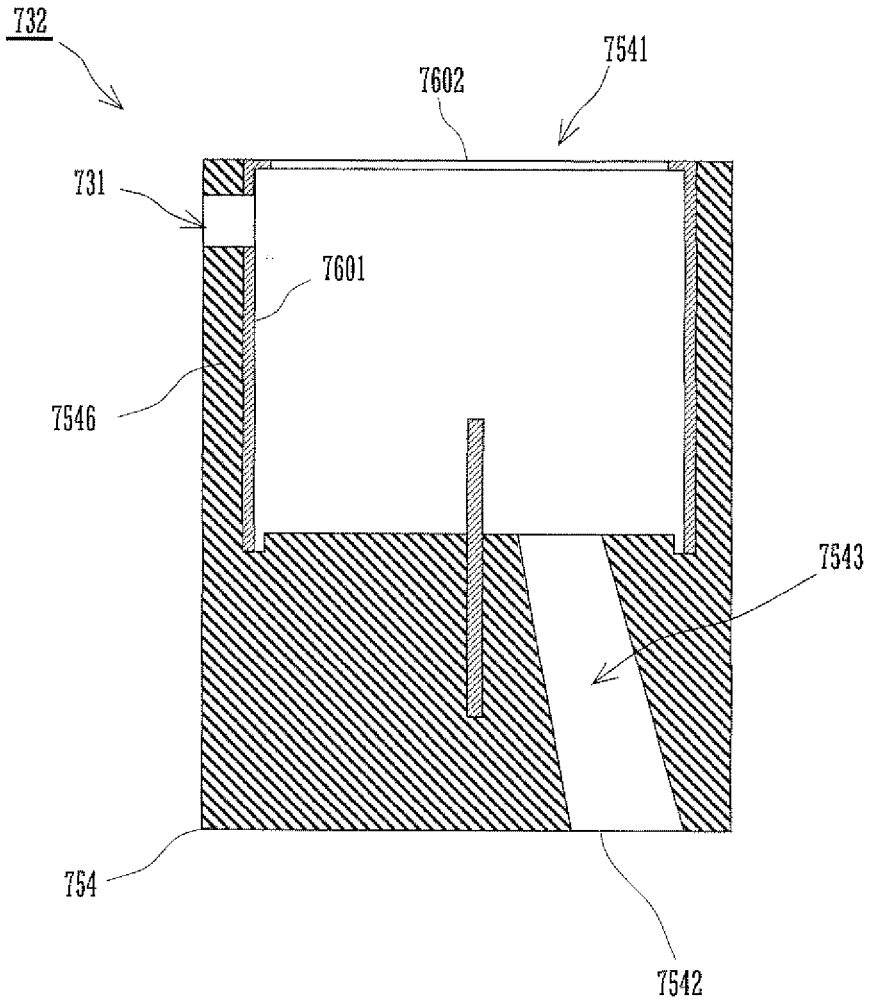
FIG. 10 is a cross-sectional view of a seventh modification example of a charging device according to one embodiment of the present invention.

As illustrated in FIG. 10, in a charging device 732 according to a seventh modification example, a box-shaped holding member 754 is provided, and a counter electrode 7601 is provided instead of the counter electrodes 6601 and 6602 of the charging device 632 illustrated in FIG. 9. The counter electrode 7601 has a U-shape in cross sec Lon, and is formed integrally with a grid electrode part 7602 located at a top face 7541 of the holding member 754. An air outlet 731 is formed at an upper portion of a side face 7546 of the holding member 754.

The above description refers to a sawtooth-shape electrode as an exemplary discharge electrode. However, the discharge electrode of the present invention is not limited to this type, and may have other shapes as long as the discharge tips are arranged intermittently.

The above described embodiments are to be considered in all respects as illustrative and not restrictive. The scope of the invention is indicated by the appended claims rather than by the foregoing description. All changes which come within the meaning and range of equivalency of the claims are intended to be embraced therein.

What is claimed is:

1. A charging device that generates corona discharge with respect to a surface of a photoreceptor in an electrophotographic image forming apparatus, comprising:

a case having a first face and a second face, the first face facing the surface of the photoreceptor, and the second face being opposed to the first face and including an air inlet;

a discharge electrode having a first long side with a plurality of discharge ends disposed intermittently, from which corona discharge takes place; and a holding member including a slit that generates a first air flow path of relatively high flow velocity directed from the air inlet to a gap of an end portion of the first face of the case on a downstream side in a moving direction of the photoreceptor surface via a center portion in a cross section of the case and a second air flow path of relatively low flow velocity that is directed to an end portion of the first face of the case on an upstream side in the moving direction of the photoreceptor surface, and wherein the holding member holds the discharge electrode so that a tip end portion of the discharge electrode is positioned in the first air flow path.

2. The charging device according to claim 1, wherein the holding member includes a first guide and a second guide having internal side faces defining the slit therebetween, the slit leading from the air inlet to an intermediate portion between the first face and the second face, wherein the discharge electrode other than the first long side is fixed at a rear face thereof to the internal side face of the first guide located in the slit.

3. The charging device according to claim 2, wherein the second guide is longer than the first guide in a direction from the second face to the first face.

4. The charging device according to claim 3, wherein the internal side face of the second guide has an end portion on a side of the first face, the end portion being inclined toward the internal side face of the first guide.

5. The charging device according to claim 4, further comprising a seal member that restricts an air flow between an inside and an outside of the case via an end portion of the first face of the case on an upstream side in the moving direction of the photoreceptor surface.

6. An image forming apparatus that forms an image in an electrophotographic manner, comprising the charging device according to claim 5.

7. The charging device according to claim 2, further comprising a seal member that restricts an air flow between an inside and an outside of the case via an end portion of the first face of the case on an upstream side in the moving direction. of the photoreceptor surface.

8. An image forming apparatus that forms an image in an electrophotographic manner, comprising the charging device according to claim 2.

9. An image forming apparatus that forms an image in an electrophotographic manner, comprising the charging device according to claim 7.

10. The charging device according to claim 3, further comprising a seal member that restricts an air flow between an inside and an outside of the case via an end portion of the first face of the case on an upstream side in the moving direction, of the photoreceptor surface.

11. An image farming apparatus that forms an image in an electrophotographic manner, comprising the charging device according to claim 10.

12. An image forming apparatus that forms an image in an electrophotographic manner, comprising the charging device according to claim 3.

13. An image forming apparatus that forms an image in an electrophotographic manner, comprising the charging device according to claim 4.

14. The charging device according to claim 1, further comprising a seal member that restricts an air flow between an inside and an outside of the case via an end portion of the first face of the case on an upstream side in the moving direction of the photoreceptor surface.

15. An image forming apparatus that forms an image in an electrophotographic manner, comprising the charging device according to claim 14.

16. An image forming apparatus that forms an image in an electrophotographic manner, comprising the charging device according to claim 1.

17. The charging device according to claim 1, wherein the slit is located on an upstream side of the case in the moving direction of the photoreceptor surface and wherein the holding member is configured to cause the first air flow path to cross from the upstream side of the case to the downstream side of the case as it passes over the tip end portion of the discharge electrode.

18. The charging device according to claim 1, wherein the air inlet is located on an upstream side of the case in a moving direction of the photoreceptor surface, and wherein the holding member is configured to cause air in the first air flow path to move from the air inlet on the upstream side of the case to an outlet of the case located at the gap on the downstream side of the first face of the case.

* * * * *